US006428190B1

(12) United States Patent
Herst et al.

(10) Patent No.: US 6,428,190 B1
(45) Date of Patent: Aug. 6, 2002

(54) ELECTRICAL POWER CORD MANAGER FOR A LIGHTING FIXTURE

(75) Inventors: Douglas J. Herst, Ross; Utkan Salman, Oakland, both of CA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/567,955

(22) Filed: May 9, 2000

(51) Int. Cl.[7] ..... F21S 8/06

(52) U.S. Cl. ..... 362/391; 362/404; 362/407; 24/129 C

(58) Field of Search ..... 362/391, 404, 362/403, 407; 24/130, 131 R, 129 A, 129 C, 115 R; 248/343, 51, 52

(56) References Cited

U.S. PATENT DOCUMENTS

| | | | | | |
|---|---|---|---|---|---|
| 856,722 | A | * | 6/1907 | Pedersen | 362/407 |
| 933,664 | A | * | 9/1909 | Powell | 362/407 |
| 1,263,783 | A | * | 4/1918 | Maier | 362/404 |
| 1,702,502 | A | * | 2/1929 | D'Olier, Jr. | 362/407 |
| 3,512,743 | A | * | 5/1970 | Lipscomb | 362/404 |
| 3,840,212 | A | * | 10/1974 | Latanision | 362/403 |
| 4,898,351 | A | | 2/1990 | Suzuki | |
| 5,031,282 | A | | 7/1991 | Denaro | |
| 5,317,493 | A | * | 5/1994 | Muller et al. | 362/404 |
| 5,519,597 | A | * | 5/1996 | Tsai | 362/386 |
| 5,836,054 | A | | 11/1998 | Alexander | |
| 5,896,623 | A | | 4/1999 | Martin | |
| 5,911,368 | A | | 6/1999 | Davignon | |

* cited by examiner

*Primary Examiner*—Thomas M. Sember
(74) *Attorney, Agent, or Firm*—Donald L. Beeson

(57) ABSTRACT

A cord manager for a suspended electric lighting fixture holds the fixture's power cord in close parallel relation to the fixture's suspension cable at electrical feed locations. The cord manager, which is suitably fabricated of extruded plastic, has an elongated first body portion with a lengthwise cable retention channel and an elongated second body portion having a power cord retention channel. In one embodiment of the invention, the retention channel for the suspension cable opens onto the power cord retention channel. In another embodiment, the suspension cable and power cord retention channels open outwardly away from each other. The cord manager provides the clean, finished look to the lighting installation at power feed locations.

26 Claims, 2 Drawing Sheets

ELECTRICAL POWER CORD MANAGER FOR A LIGHTING FIXTURE

BACKGROUND OF INVENTION

The present invention generally relates to the installation of electric lighting fixtures, and more particularly to visual distractions associated with the installation of ceiling suspended lighting fixtures having exposed electrical power cords that must be extended between the fixtures and the overhead ceiling.

Lighting designs for architectural spaces frequently include linear fluorescent lighting fixtures suspended from an overhead ceiling structure where the lighting fixtures become an architectural element within the space. In office environments a typical lighting installation will include the suspension of runs of linear direct or indirect lighting fixtures below a grid ceiling from multiple suspension points located on the ceiling grid. Each run of fixtures will require at least one power feed location where a potentially unsightly power cord must be run from the lighting fixture up to an electrical junction box above the ceiling grid. In older installations, the runs of lighting fixtures were suspended by hollow stems which permitted the fixture's power cord to be fed through the stem at the power feed locations. The rigid stems thus concealed the power cords and provided a clean, finished look to the installation.

However, rigid stem designs became impractical with the introduction of earthquake building codes in earthquake-prone areas, such as California, which require that a fixture be allowed to sway during a seismic event. One response to earthquake codes was to use ball stems having a ball joint that permitted a suitable swivel motion about the stem. This solution preserved the advantage of being able to hide the power cord since, like rigid stems, ball stems are hollow. But ball stems have a decided disadvantage in that they, like rigid stems, are relatively costly and difficult to install. As a result, most installations now use less costly aircraft cable to suspend lighting fixtures and simply drop the power cords next to the cables where the power cords are visible instead of hidden from view. Aircraft cable is flexible and allows the fixture to sway thereby meeting earthquake codes, and can easily be installed from grid ceilings at any location, including off grid locations.

The problem with aircraft cable is the visibility of the power cords dropped next to the cable. Power cords have natural bends which, unlike the finished appearance of stem systems, present a casual or awkward appearance which can be visually objectionable. To mitigate this problem, designers often require that the power cord be tied to the suspension cable using cable ties or clips, however, in many cases this still does not provide the finished look desired. First, with ties or clips it is difficult to keep the cord perfectly straight against the suspension cable, and the ties and clips themselves can be a visual detraction.

The present invention provides a power cord manager that overcomes the aesthetic disadvantages of using aircraft cable instead of hollow stems to suspend linear fluorescent lighting. It also overcomes the disadvantages of using conventional cable ties or clips to hold an external power cord next to a fixture suspension cable. The present invention further provides a cord manager that is inexpensively manufactured, easy to install, and that can keep the power cord in a straight parallel relation to the suspension cable over most of the length of the power cord. Still further, the present invention provides a convenient tool to the designer of suspended lighting systems for achieving a desired finished look at electrical feed locations.

SUMMARY OF INVENTION

Briefly, the present invention is a power cord manager for the power cord of a suspended electric lighting fixture having a suspension cable near the location of the power cord. The power cord manager is comprised of first and second elongated body portions which are preferably integrally connected and which preferably have a uniform cross-sectional shape such that the cord manager can be fabricated from an extruded strip of material, such as plastic or aluminum, cut to a desired length.

The first body portion of the cord manager has a lengthwise cable retention channel with a lengthwise side opening for fitting the suspension cable of the lighting fixture into the channel. Both the cable retention channel and its side opening are sized and shaped to receive and capture the suspension cable over the length of the channel. The second body portion similarly has a lengthwise power cord retention channel having a lengthwise side opening through which the electrical power cord of the lighting fixture can be fitted. This side opening and retention channel are parallel to the cable retention channel of the first body portion and are sized to receive and capture the power cord of the lighting fixture so that the power cord is held in close parallel relation to the suspension cable captured in the cable retention channel.

In one aspect of the invention, the side opening for the cable retention channel opens onto the power cord retention channel such that the suspension cable is first passed through the power cord retention channel before being received by the cable retention channel. In another aspect of the invention, the side openings for both the cable and power cord retention channels face outwardly away from each other to separately receive the suspension cable and power cord. The cable retention channel and power cord retention channel and their respective side openings can be oriented at different angles relative to each other as hereinafter described.

In a further aspect of the invention, the first and second body portions of the cord manager have a thin wall construction wherein the first body portion has a first elongated semi-circular thin wall portion forming a lengthwise circular cable retention channel, and wherein the second elongated semi-circular thin wall portion forms a lengthwise circular power cord retention channel.

Therefore, it can be seen that a primary object of the invention is to provide a cord manager for the electrical power cord of a suspended lighting fixture which permits the power cord to be held in close parallel relation to a fixture suspension cable over the length of the cord manager. It is a further object of the invention to provide a power cord manager that provides a clean, finished look to the fixture's suspension, that can be fabricated inexpensively, and that is relatively easy to install. Other objects of the invention will be apparent from the following specification and claims.

DETAILED DESCRIPTION OF THE ILLUSTRATED EMBODIMENT

Figure 1:
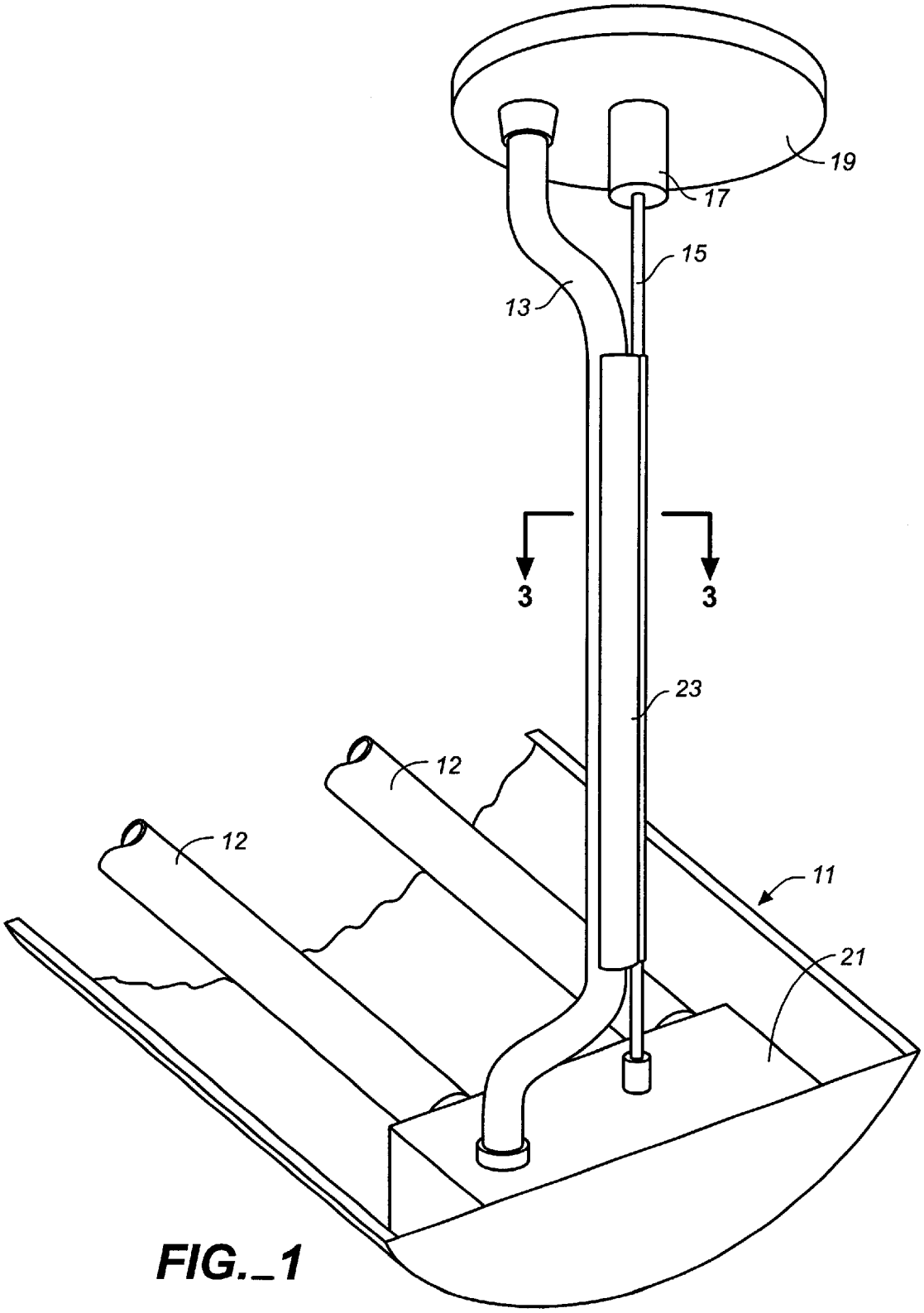
FIG. 1 is a fragmentary top perspective view of a linear fluorescent lighting fixture suspended from an overhead ceiling at an electrical feed location, and showing the cord manager of the invention holding the fixture's power cord to the suspension cable of the fixture.

Turning now to the drawings, FIG. 1 shows a fluorescent lighting fixture 11 with fluorescent lamps 12 and a flexible electrical power cord 13 suspended by means of a suspension cable 15 at an electrical feed location of an overhead ceiling, such as a grid ceiling (not shown). The suspension cable is typically provided in the form of flexible steel aircraft cable having an internally threaded fitting 17 for attaching the top end of the cable to a threaded hanger rod (not shown) which extends through ceiling canopy 19 from an overhead load bearing ceiling hanger bracket such as disclosed in U.S. Pat. No. 5,484,076. The bottom end of the cable is in turn attached to a mounting bracket 21 at end of the fixture, The electrical power cord 13, which is also connected to the fixture through mounting bracket 21, has sufficient length to be flexibly routed along the suspension cable.

The power cord 13 and suspension cable 15 are tied together in a finished, aesthetically pleasing installation by the cord manager of the invention, alternative embodiments of which are illustrated in the drawings. Referring to the embodiment shown in FIGS. 1–3, the cord manager 23 is seen to have elongated first and second body portions 25, 27, which are preferably integrally connected and which preferably are formed from a single extruded strip of plastic or aluminum, but which could be two separate parts joined together by any suitable fastening structure or material. The first body portion has a relatively small lengthwise cable retention channel 29 while a larger lengthwise power cord retention channel 31 is provided in the second body portion in parallel relation to the cable retention channel. Each of these retention channels run the entire length of the cord manager to permit the suspension cable and power cord for a lighting fixture to be fitted into and held together by their respective channels over the entire length of the cord manager.

Figure 2:
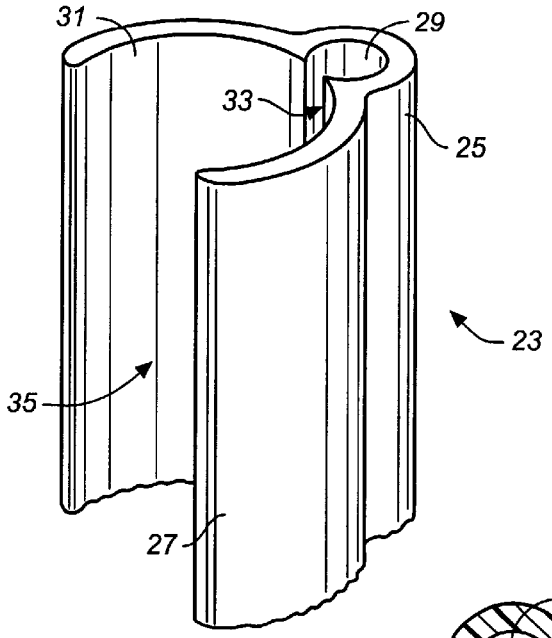
FIG. 2 is a top perspective fragmentary view of the power cord manager shown in FIG. 1.
Figure 3:
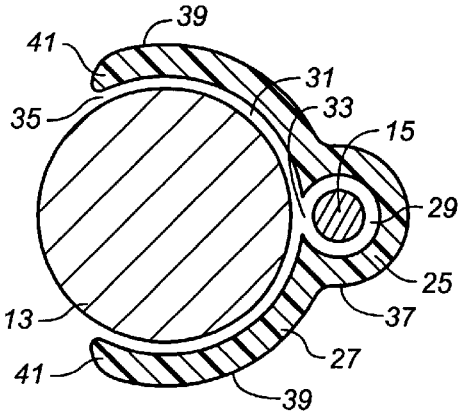
FIG. 3 is a cross-sectional view thereof showing the suspension cable and power cord captured within the cord manager.

To permit the suspension cable 15 to be fitted into cable retention channel 29, this retention channel has a lengthwise side opening 33, which in the embodiment of FIGS. 1–3 opens onto the power cord retention channel 31. Thus, the suspension cable must first be passed through the power cord retention channel before being received by the cable retention channel. Similarly, to permit the electrical power cord 13 to be fitted into power cord retention channel 31, the power cord retention channel has a lengthwise side opening 35 sized to receive the power cord. In the preferred embodiment the retention channels each have a circular cross-sectional shape sized to conform to the round geometry of the power cord and suspension cable which they retain, however, it will be appreciated that retention channels of other shapes could be used so long as the channels are capable of receiving and holding the cord and cable in parallel relation over the length of the cord manager. Also, while the side opening 33 of the cable retention channel is generally sized to receive the suspension cable 15, the sizing of this channel in the embodiment of FIGS. 1–3 is not critical since the power cord will act to hold the suspension cable in place. On the other hand, the side opening 35 of the power cord retention channel must be sized to capture the power cord. For this to occur, the opening should be slightly smaller than the diameter of the cord so that the cord can be pressed through the opening without falling out.

With further reference to FIGS. 1–3, first and second body portions 25, 27 of the cord manager 23 are shown as having a connected thin wall construction, wherein a small radius arcuate back wall 37 of the first body portion forms a relatively small diameter cable retention channel, and wherein two relatively large radius arcuate front walls 39 of the second body portion form a relatively large power cord retention channel. Due to the thin wall construction, the ends 41 of arcuate front walls 39 which form side opening 33 will be capable of flexibly expanding around the electrical power cord as the power cord is pressed into its retention channel. Flexure of the front walls 39 will also produce a clamping force on the power cord.

Suitably, the cord manager can be a plastic part having a wall thickness of approximately 0.04 inches, with a cable retention channel diameter of approximately 0.10 inches to accommodate standard sized aircraft cable used in the lighting industry, and a power cord retention channel diameter of approximately 0.38 inches to accommodate a standard sized power cord. Alternatively, the cord manager could be fabricated of extruded aluminum having a very thin wall construction with a desired finish such as a polished or anodized finish. The invention could also be fabricated of other materials using other fabrication processes, however, use of such other materials and/or processes would not be considered the preferred embodiments of the invention.

Figure 4:
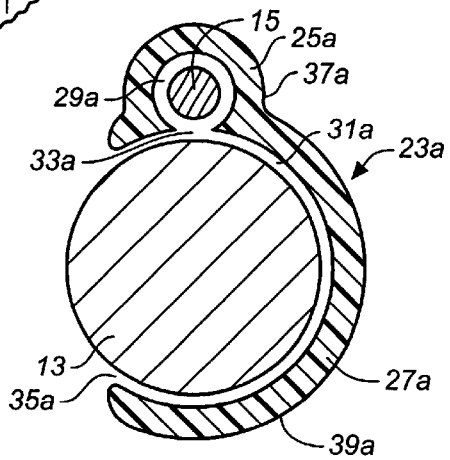
FIG. 4 is a cross-sectional view of an alternative embodiment of the cord manager of the invention, wherein the cable suspension channel of the cord manager is rotated by 90 degrees.

Referring to FIGS. 3 and 4, it is seen that the cable retention channel 29, which in both of the embodiments opens onto the power cord retention channel 31, can be positioned at any angle relative to the side opening 35 for the power cord retention channel. In FIG. 3 the cable retention channel is directly opposite side opening 35, whereas in FIG. 4 cord manager 23*a* has a cable retention channel 29*a* which is at a 90 degree angle relative to the side opening 35*a* for the power cord retention channel 31*a*. In either embodiment, the parallel channels keep the suspension cable and power cord in close parallel relation to each other.

Figure 5:
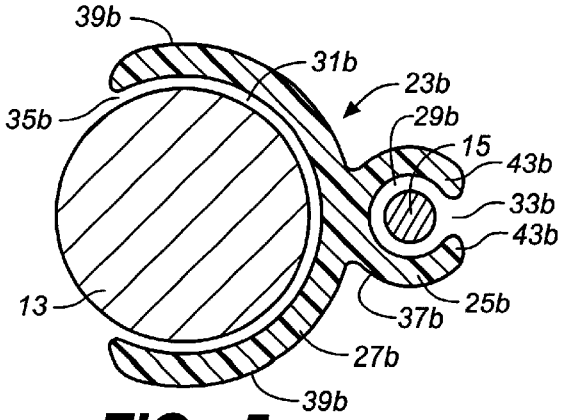
FIG. 5 is a cross-sectional view of a further embodiment of the invention wherein the suspension cable and power cord retention channels face away from each other.
Figure 6:
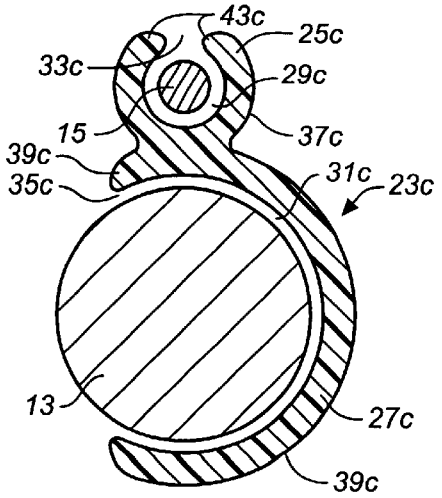
FIG. 6 is a cross-sectional view of an alternative embodiment shown in FIG. 5 wherein the suspension cable retention channel is rotated by 90 degrees.

FIGS. 5 and 6 show alternative embodiments of the invention wherein the side openings of the power cord and cable retention channels both face outwardly such that neither one opens on to the other. In FIG. 5 cord manager 23*b* has a first body portion 25*b* having arcuate back walls 37*b* which form cable retention channel 29*b* and side opening 33*b*. A second body portion 27*b* has arcuate front walls 39*b* which form power cord retention channel 31*b* and side opening 35*b* which is rotated 180 degrees from the cable channel's side opening 33*b*. FIG. 6 similarly shows a cord manager 23*c* having first and second body portions 25*c*, 27*c* wherein arcuate side walls 37*c* form cable retention channel 29*c* and arcuate front walls 39*c* form power cord retention channel 31*c*. In this embodiment the side openings 33*c*, 35*c* of the of the retention channels are 90 degrees instead of 180 degrees apart. In both the FIGS. 5 and 6 embodiments the size of the openings 33*b*, 33*c* for the cable retention channels are more critical than is the case in the embodiments shown in FIGS. 1–4. These openings should be slightly smaller than the diameter of the suspension cable 15 so that the cable can be pressed through and retained behind the opening. Again, the thin wall construction of the sidewalls will permit ends 43*b*, 4*c* of the arcuate walls 37*b*, 37*c* forming these openings to flexibly expand to receive the suspension cable.

To use a cord manager designed in accordance with the embodiments shown in FIGS. 3 and 4, a cord manager of suitable length as determined by the height of the suspension is first placed on a suspension cable 15 found at the lighting fixture's power feed location. This is achieved by simply passing the suspension cable through the larger power cord retention channel 31, 31*a* into the smaller cable retention channel 29, 29*a*. With the suspension cable in place, the power cord 13 is pressed into its retention channel through side opening 35, 35*a* to lock the power cord and suspension cable together over the length of the cord manager. To use the embodiments of FIGS. 5 and 6, the power cord 13 and suspension cable 15 can be pressed into their respective retention channels in any order since one retention channel does not open onto the other.

To provide desired visual accents the cord manager of the invention can be provided in different colors. Also, if visually desired the retention channels for the suspension cable and power cord can be provided with greater separation, such as by providing a web structure between the first and second body portions of the cord manager. In any case, the power cord will be held in a relatively close parallel relation to the suspension cable with a structure that provides a clean, finished look to the lighting installation.

While the present invention has been described in considerable detail in the foregoing specification and accompanying drawings, it is understood that it is not intended that the invention be limited to such detail, except as necessitated be the following claims.

What we claim is:

1. A cord manager for a suspended lighting fixture having an electrical power cord and suspended by a suspension cable near the location of said electrical power cord, said cord manager comprising a first elongated body portion having a lengthwise cable retention channel therethrough and having a lengthwise side opening to said cable retention channel for fitting the suspension cable of the lighting fixture into said channel, said side opening and cable retention channel being sized and shaped to receive and capture the suspension cable of the lighting fixture, and a second elongated body portion having a lengthwise power cord retention channel therethrough and having a lengthwise side opening to the power cord retention channel for fitting the electrical power cord of the lighting fixture into said channel, said side opening and power cord retention channel being sized to receive and capture the power cord of a lighting fixture, said first elongated body portion being in close parallel relation to said second elongated body portion such that the electrical power cord captured in the power cord retention channel is held in close parallel relation to the suspension cable captured in the cable retention channel.

2. The cord manager of claim 1 wherein the side openings of said first and second body portions face outwardly away from each other to separately receive the suspension cable and the power cord of the lighting fixture.

3. The cord manager of claim 2 wherein the side openings face outwardly approximately 180 degrees apart.

4. The cord manager of claim 2 wherein said side openings are approximately 90 degrees apart.

5. The cord manager of claim 1 wherein said power cord retention channel is larger than said cable retention channel, and wherein the side opening of the first elongated body portion opens onto the power cord retention channel of said second elongated body portion such that the suspension cable is first passed through the power cord retention channel before being received by said cable retention channel.

6. The cord manager of claim 1 wherein said first and second body portions are integrally connected.

7. The cord manager of claim 6 wherein said first and second body portions are fabricated from a plastic extrusion.

8. The cord manager of claim 1 wherein said power cord and cable retention channels have a circular cross-sectional shape sized to conform to the size of a power cord and a suspension cable having circular cross-sections.

9. The cord manager of claim 8 wherein the cross-sectional diameter of said cable retention channel is approximately 0.10 inches and the cross-sectional diameter of said power cord retention channel is approximately 0.38 inches.

10. A cord manager for a suspended lighting fixture having an electrical power cord and suspended by a suspension cable near the location of said electrical power cord, said cord manager comprising an elongated unitary body, said body including a first elongated semi-circular wall portion forming a lengthwise circular cable retention channel and a lengthwise side opening to said cable retention channel for fitting the suspension cable of the lighting fixture into said channel, said side opening and cable retention channel being sized and shaped to receive and capture the suspension cable of the lighting fixture, and a second elongated semi-circular wall portion forming a lengthwise circular power cord retention channel and a lengthwise side opening to the power cord retention channel for fitting the electrical power cord of the lighting fixture into said channel, said side opening and power cord retention channel being sized to receive and capture the power cord of the lighting fixture.

11. The cord manager of claim 10 wherein the side openings to said cable retention channel and said power cord retention channel face outwardly away from each other to separately receive the lighting fixture suspension cable and power cords.

12. The cord manager of claim 11 wherein the side openings are approximately 180 degrees apart.

13. The cord manager of claim 11 wherein the side openings are approximately 90 degrees apart.

14. The cord manager of claim 10 wherein said power cord retention channel is larger than said cable retention channel, and wherein the side opening to said cable retention channel opens onto the power cord retention channel such that the suspension cable is first passed through the power cord retention channel before being received by said cable retention channel.

15. The cord manager of claim 14 wherein the side openings are approximately 180 degrees apart.

16. The cord manager of claim 14 wherein the side openings are approximately 90 degrees apart.

17. The cord manager of claim 10 wherein said elongated unitary body is fabricated from a plastic extrusion.

18. The cord manager of claim 17 wherein the cross-section of the elongated unitary body has the following approximate dimensions: wall thickness—0.04 inches; diameter of cable retention channel—0.10 inches; and diameter of said power cord retention channel—0.38 inches.

19. The cord manager of claim 10 wherein said elongated unitary body is fabricated from a thin wall aluminum extrusion.

20. A cord manager for a suspended lighting fixture having an electrical power cord and suspended by a suspension cable near the location of said electrical power cord, said cord manager comprising a first elongated thin wall body portion having a lengthwise cable retention channel therethrough and having a lengthwise side opening to said cable retention channel for fitting the suspension cable of a lighting fixture into said channel, said side opening and cable retention channel being sized and shaped to receive and capture the suspension cable of a lighting fixture, and a second thin wall elongated body portion integrally connected to said first body portion, said second thin wall elongated body portion having a lengthwise power cord retention channel therethrough and a lengthwise side opening to the power cord retention channel for fitting the electrical power cord of a lighting fixture into said channel, said side opening and power cord retention channel being sized to receive and capture the power cord of a lighting fixture, said first elongated body portion being in close parallel relation to said second elongated body portion such that an electrical power cord captured the is held in close parallel relation to the captured in cable retention channel.

21. The cord manager of claim 20 wherein said power cord retention channel is larger than said cable retention channel, and wherein the side opening of the first elongated body portion opens onto the power cord retention channel of said second elongated body portion such that the suspension cable is first passed through the power cord retention channel before being received by said cable retention channel.

22. The cord manager of claim 21 wherein the side openings are approximately 180 degrees apart.

23. The cord manager of claim 21 wherein the side openings are approximately 90 degrees apart.

24. The cord manager of claim 21 wherein said elongated unitary body is fabricated from a plastic extrusion.

25. The cord manager of claim 24 wherein the cross-section of the elongated unitary body has the following approximate dimensions: wall thickness—0.04 inches; diameter of cable retention channel—0.10 inches; and diameter of said power cord retention channel—0.38 inches.

26. The cord manager of claim 21 wherein said elongated unitary body is fabricated from a thin wall aluminum extrusion.

* * * * *